United States Patent [19]

Wietschorke et al.

[11] Patent Number: 4,573,441

[45] Date of Patent: Mar. 4, 1986

[54] VALVE ARRANGEMENT

[75] Inventors: Stephan Wietschorke, Usingen; Gerhard Ruschek, Hattersheim; Andreas Sausner, Frankfurt am Main, all of Fed. Rep. of Germany

[73] Assignee: VDO Adolf Schindling AG, Frankfurt am Main, Fed. Rep. of Germany

[21] Appl. No.: 636,530

[22] Filed: Aug. 1, 1984

[30] Foreign Application Priority Data

Aug. 11, 1983 [DE] Fed. Rep. of Germany ..... 3328950

[51] Int. Cl.[4] ..... F02D 31/00

[52] U.S. Cl. ..... 123/339; 123/585; 251/117; 137/599

[58] Field of Search ..... 123/339, 585, 586; 251/45, 117, 282; 137/599, 630.14

[56] References Cited

U.S. PATENT DOCUMENTS

| | | | |
|---|---|---|---|
| 4,082,116 | 4/1978 | Stampfli | 251/45 |
| 4,125,100 | 11/1978 | Assenheimer et al. | 123/585 |
| 4,245,813 | 1/1981 | Grenier | 251/45 |
| 4,356,802 | 11/1982 | Kern et al. | 123/585 |
| 4,385,603 | 5/1983 | Bonse et al. | 123/585 |
| 4,425,887 | 1/1984 | Knapp et al. | 123/339 |

FOREIGN PATENT DOCUMENTS

| | | | |
|---|---|---|---|
| 18173 | 2/1981 | Japan | 251/117 |

*Primary Examiner*—Parshotam S. Lall

*Attorney, Agent, or Firm*—Martin A. Farber

[57] ABSTRACT

An improvement is disclosed for a valve arrangement for adjusting the idling speed of an engine of the type having an intake manifold and a throttle valve in the manifold. In this arrangement there is a bypass of the throttle valve, and an electromechanical setting element and a solenoid connected to a closure member for the bypass via a setting member. A return spring biases the setting member in a closing direction and the solenoid can urge the setting member in an opening direction against the force of the return spring. The closure member is urged in the opening direction by pressure on the admission side of the manifold. This admission side is connected to a chamber having a moveable wall connected to the closure member. In accordance with the improvement the chamber is connected to the intake side of the manifold by a connection which includes a valve which is adapted to close the connection during a control process.

14 Claims, 1 Drawing Figure

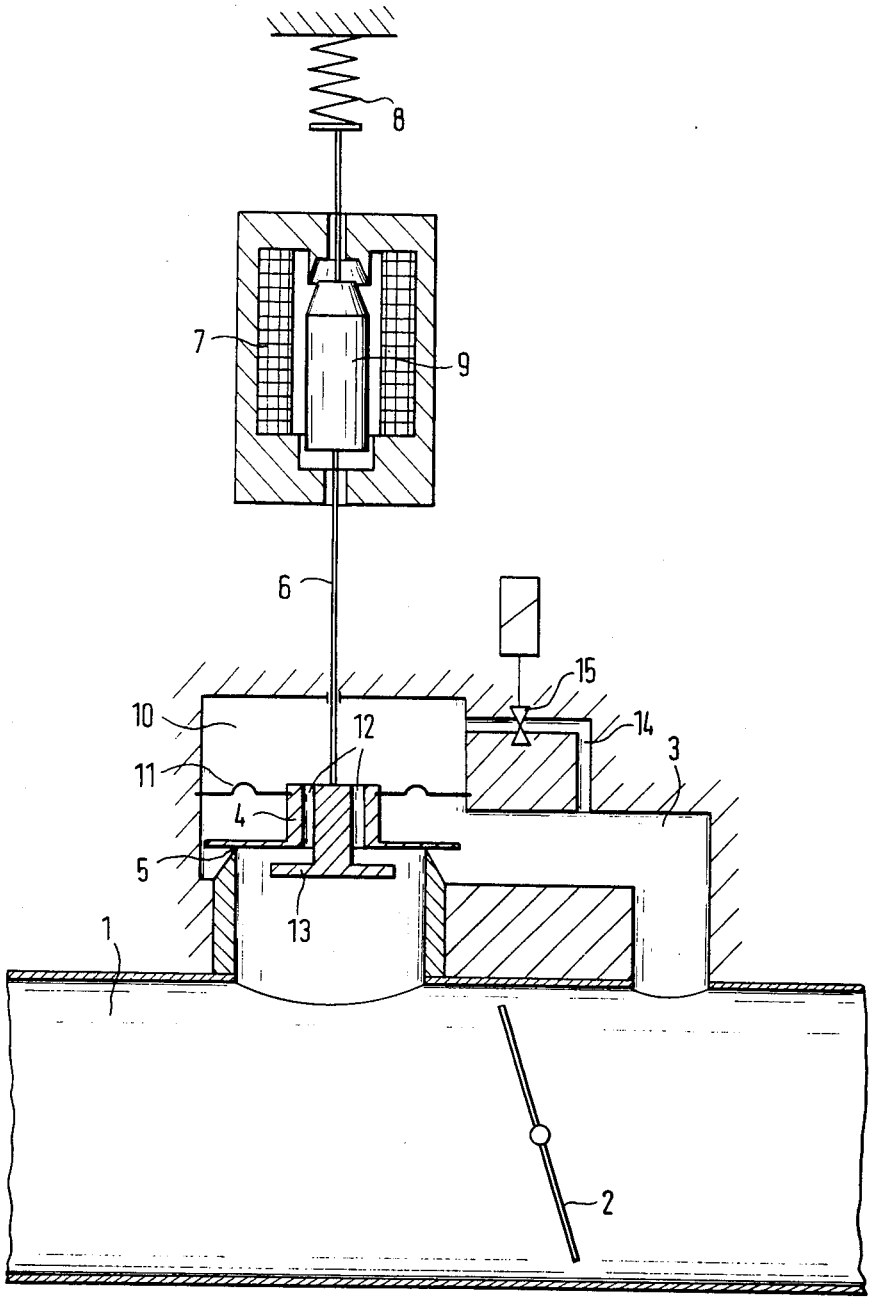
8
7
9
6
15
10
12
14
3
11
4
5
13
1
2

VALVE ARRANGEMENT

FIELD AND BACKGROUND OF THE INVENTION

The invention relates to a valve arrangement in general.

This valve arrangement is adapted to adjust the idling speed of internal combustion engines having an intake manifold and a throttle valve in the manifold by controlling the quantity of air on the intake side of the intake manifold leading to the internal combustion engine. The arrangement includes a bypass of the throttle valve and an electromechanical setting element including a solenoid arranged to move a closure member for the bypass via a setting member in an opening direction against the force of a return spring. The closure member is also biased in the opening direction by the pressure on the admission side of the manifold. The admission side is connected via channels to a chamber which has a movable wall which is connected to a rear portion of the closure member.

Such a valve arrangement serves to keep the idling speed of the engine as low as possible while at the same time regulating the speed of the engine in such a manner that when additional loads are applied, such as, loads caused by auxiliary units, the idling speed is not reduced to such an extent that the engine stalls. To accomplish this result the solenoid is acted on by a setting current which is generated, inter alia, as a function of the actual speed of the engine. This current causes a displacement of the closure member such that the actual speed of the engine reaches a predetermined desired speed substantially independent of any disturbing variables.

When the solenoid is not acted on by current, the setting member and, together with it, the closure member are typically moved by the return spring either into a completely open position or into a completely closed position. This occurs when no current acts on the solenoid because the vehicle is not moving. A lack of current may also be caused, however, by a defect in the circuit which supplies current to the solenoid.

In the traditional valve arrangements of this type a lack of current to the solenoid thus results in the engine either operating at maximum idling speed or operating at minimum idling speed, with danger of stalling.

It is an object of the invention, therefore, to create a valve arrangement of this type which, while being of simple construction, assures, upon failure of the solenoid, the lowest possible idling speed consistent with prevention of stalling of the engine.

SUMMARY OF THE INVENTION

According to the invention, a chamber (10) is connected with the engine intake (suction) side (right side of FIGURE) of an intake manifold via a valve (15) which is closed during a control operation of the closure member (4) via the solenoid (7). As a result of this development there occurs an equalization of pressure in the chamber (10) with the pressure at the admission side (left side of FIGURE) of the manifold during the control operation so that the amount of the opening of the closure member (4 away from seat 5) is determined solely by the control current of the solenoid (7) and the spring force of the return spring (8) which acts in opposition. When no control operation occurs the chamber (10) communicates with the intake side (right side of FIGURE) of the manifold which has a lower pressure (suction) than the admission side (left side of FIGURE). This eliminates the previous equalization of the pressure at the closure member in the sense that now the higher pressure at the admission side moves the closure member (4) in its opening direction against the force of the return spring (8) unitl the forces acting on the closure member are in equilibrium. The degree of opening in this equilibrium is predetermined so as to be sufficient to assure an idling speed which is high enough to prevent stalling of the engine.

The reason for such a non-occurrence of a control operation is immaterial. It may result, for instance, from a disconnection or interruption of the control current or from a defect in the control circuit for the control current.

The valve is preferably an electromagnetic valve (15), which preferably is acted on by the setting current of the solenoid (7). By this the electromagnetic valve is closed automatically when current acts on the solenoid a during control operation.

In a simple embodiment of the invention the setting element is a lift rod (6) which is connected with the movable core (9) of the solenoid (7).

In order to achieve an equalization of pressure in simple fashion, the admission side and chamber side active surfaces of the closure member are advantageously approximately the same area.

The movable wall can be formed by the closure member.

Alternatively the movable wall may be a membrane (11) arranged between the closure member and the wall of the chamber (10).

Channels which are difficult to produce in the housing of the valve arrangement can be dispensed with if the connection between the admission side and the chamber (10) consists of a channel (12) which is developed axially in the closure member (4).

In this connection, distortions of the pressure conditions on both sides of the closure member caused by the flow of air, may be avoided if the admission side mouth of the channel (12) is directed radially.

If the relation of the cross sections of the connection 12 of the admission side with the chamber (10) and of the connection (14) of the chamber (10) with the intake side is such that the force counteracting the admission is low enough to allow an opening of the closure member (4) with a well-defined throughput of air through the valve arrangement then a dynamic equilibrium can be obtained at the closure member.

BRIEF DESCRIPTION OF THE DRAWING

One embodiment of the invention is shown in the drawing and will be described in further detail below. The sole FIGURE of the drawing shows a cross section through a valve arrangement in accordance with the invention.

DETAILED DESCRIPTION OF THE PREFERRED EMBODIMENT

A throttle valve 2 is arranged in rotatable manner in an intake manifold or passage 1 leading to an internal combustion engine (not shown). The region in front of the throttle valve 2 in connected with the region behind the throttle valve 2 by a bypass 3.

The passage through the bypass 3 can be closed to a greater or lesser extent by a valve arrangement including a closure member 4 which is movable towards a valve seat 5.

If the closure member 4 is seated, no air can flow via the bypass 3 directly from the atmosphere side to the intake side of the intake manifold 1.

The closure member 4 is axially displaceable between the position of rest and an operating position and is connected to a lift rod 6 which bears a core 9 of a solenoid 7, the rod 6 being biased in a closing direction by a return spring 8. Upon application of current to the solenoid 7 the lift rod 6 is moved in the bypass opening direction in opposition to the force of the return spring 8 to an extent governed by the magnitude of the current.

On the side of the closure member 4 facing away from the valve seat 5 there is a chamber 10, the wall of which facing the valve seat 5 being a movable wall comprising a membrane or diaphragm 11. This membrane 11 has its central region connected to the closure member 4 so that the pressure prevailing in the chamber 10 acts also on the closure member 4 via the membrane. The admission-side active (effective) surface of the closure member 4 and the active (effective) surface of the membrane 11 including the portion of the closure member in the chamber 10 are in this connection approximately the same size.

The admission side of the closure member 4 communicates with the chamber 10 by channels 12 formed in the closure member 4. The admission-side mouths of the channels 12 are protected by a mushroom-like covering 13 against direct axial flow of air into the channels 12. As a result, these mouths of the channels 12 effectively open only in a radial direction.

The chamber 10 is connected via a connection 14 with the intake side of the intake manifold 1. This connection 14 is adapted to be closed by an electromagnetic valve 15.

The electromagnetic valve 15 is open when no current is present and is activated by the setting current which drives the solenoid 7. Thus, the electromagnetic valve 15 is closed when current acts on the solenoid 7.

The cross sections of the channels 12 are related to the cross section of the connection 14 in a manner such that the force opposing the pressure at the admission side opens the closure member 4 with a precisely defined throughput of air. The degree of opening, it is true, changes corresponding to the admission pressure prevailing at the time. The rate of passage of air, however, remains constant.

During idling operation of the internal combustion engine (not shown) the solenoid 7 is acted on by a setting current produced by a regulator (not shown) so that the core 9 and, with it, the lift rod 6 and the closure member 4 are moved away from the valve seat 5 against the force of the return spring 8.

Since the electromagnetic valve 15 is acted on by current and closes at the same time as the solenoid 7 is acted on by current, the magnetic force of the solenoid 7 is also opposed by the pressure which is building up in the chamber 10. This pressure corresponds to the admission side pressure on the closure member 4 so that, due to the opposing previously mentioned active (effective) surfaces of equal size of the closure member 4 and the membrane 11, the closure member 4 is movable independently of the action of the pressure.

I claim:

1. In a valve arrangement for adjusting the idling speed of an internal combustion engine having an intake manifold and a throttle valve in the manifold, by controlling the quantity of air at an intake side of the intake manifold leading to the internal combustion engine, including a bypass of the throttle valve, an electromechanical setting element having a solenoid connected to a closure member for the bypass via a setting member, a return spring biasing the setting member in a closing direction, said solenoid being adapted to urge said setting member in an opening direction against the force of the return spring, the closure member being urged in the opening direction by pressure at an admission side of the manifold, and the admission side being connected to a chamber including a movable wall connected to a rear portion of the closure member, the improvement comprising:

means comprising another valve for connecting said chamber to the intake side of the manifold and for closing during a control operation of the closure member via said solenoid.

2. The valve arrangement according to claim 1, wherein said solenoid includes a moveable core and said setting member comprises a lift rod connected to said movable core.

3. The valve arrangement according to claim 2, wherein said solenoid including said moveable core comprise a pull magnet.

4. The valve arrangement according to claim 1, wherein said closure member has an admission side active surface facing the admission side of said manifold and a chamber side active surface facing said chamber, said active surfaces being of approximately equal area.

5. The valve arrangement according to claim 1, wherein said movable wall is formed by said closure member.

6. The valve arrangement according to claim 1, wherein said movable wall includes a membrane arranged between said closure member and a wall of said chamber.

7. The valve arrangement according to claim 1, wherein said another valve is an electromagnetic valve.

8. The valve arrangement according to claim 7, wherein said means includes a connection between said chamber and the intake side of the manifold, said another valve is disposed in said connection, said solenoid is responsive to a setting current for urging said setting member in the opening direction; and said electromagnetic valve is responsive to said setting current for closing said connection.

9. The valve arrangement according to claim 7, wherein at least one channel is formed in said closure member, the admission side of said manifold is connected to said chamber via said channel in said closure member.

10. The valve arrangement according to claim 9, wherein the channel has an admission side mouth directed radially with respect to said closure member.

11. The valve arrangement according to claim 9, wherein said means includes a connection between said chamber and the intake side of the manifold, said another valve is disposed in said connection, the cross section of the channel connecting the admission side of the manifold to the chamber is related to the cross section of said connection of the chamber with the intake side of the manifold in such a manner that the force in said chamber counteracting the admission pressure allows an opening of the closure member such that a defined throughput of air occurs through said valve arrangement and a dynamic equilibrium of said closure member is obtained.

12. The valve arrangement according to claim 9, wherein said channel is formed axially in said closure member.

13. The valve arrangement according to claim 9, wherein said channel is formed longitudinally in said closure member.

14. In a valve arrangement for adjusting the idling speed of an internal combustion engine having an intake manifold and a throttle valve in the manifold, by controlling the quantity of air at an intake side of the intake manifold leading to the internal combustion engine, including a bypass of the throttle valve, an electromechanical setting element having a solenoid connected to a closure member for opening and closing respectively the bypass via a setting member, the improvement comprising:

a return spring biasing the setting member and said closure member in a direction of closing the bypass, said solenoid in a control operation comprising means for urging said setting member and said closure member against the force of the return spring in a direction of opening the bypass, the closure member being applied and urged in the opening direction by pressure at an admission side of the manifold, a chamber including a movable wall connected to a rear portion of the closure member, said chamber being connected to said admission side, and means comprising another valve for connecting said chamber to the intake side of the manifold and for closing the connection of said chamber to the intake side of the manifold during said control operation of the clousure member via said solenoid.

* * * * *